United States Patent [19]

Greenwood

[11] 4,283,269

[45] Aug. 11, 1981

[54] PROCESS FOR THE PRODUCTION OF A FEEDSTOCK FOR CARBON ARTIFACT MANUFACTURE

[75] Inventor: Sydney H. J. Greenwood, Sarnia, Canada

[73] Assignee: Exxon Research & Engineering Co., Florham Park, N.J.

[21] Appl. No.: 115,299

[22] Filed: Jan. 25, 1980

Related U.S. Application Data

[63] Continuation-in-part of Ser. No. 29,760, Apr. 13, 1979.

[51] Int. Cl.[3] ..... C10C 3/08

[52] U.S. Cl. ..... 208/45; 208/22; 423/447.4

[58] Field of Search ..... 208/22, 44, 45, 96, 208/309; 423/447.4

[56] References Cited

U.S. PATENT DOCUMENTS

| | | | |
|---|---|---|---|
| 3,364,138 | 10/1960 | Campagne | 208/45 |
| 3,490,586 | 1/1970 | Jaisle | 208/45 |
| 3,595,946 | 7/1971 | Joo et al. | 423/447.6 |
| 4,055,583 | 10/1977 | Kolling et al. | 208/41 |
| 4,184,942 | 1/1980 | Angier et al. | 208/22 |

*Primary Examiner*—Delbert E. Gantz
*Assistant Examiner*—William Leader
*Attorney, Agent, or Firm*—Joseph J. Dvorak

[57] ABSTRACT

Broadly stated, the present invention comprises: fluxing an isotropic carbonaceous pitch thereby rendering the pitch fluid. Next, the fluxed pitch is introduced into a heating zone where the temperature is maintained in the range of from about 350° C. to about 450° C., thereby resulting in the heat soaking of the fluxed pitch. In a continuous process, at least some of the fluxed pitch is simultaneously removed or drawn off from the heating zone and transferred to a cooling zone. The temperature in the cooling zone generally ranges from above the freezing point of the fluxed pitch to below the temperature in the heating zone, and in a particularly preferred embodiment is maintained at the boiling point of the organic liquid used to flux the pitch. Any solids suspended in the fluxed pitch after heat soaking and cooling are removed by filtering or the like. Thereafter, the fluxed, heat soaked pitch is treated with an anti-solvent compound so as to precipitate at least a portion of the pitch free of quinoline insoluble solids.

10 Claims, 2 Drawing Figures

PROCESS FOR THE PRODUCTION OF A FEEDSTOCK FOR CARBON ARTIFACT MANUFACTURE

CROSS-REFERENCE TO RELATED APPLICATION

This application is a continuation-in-part of U.S. Ser. No. 29,760, filed Apr. 13, 1979.

FIELD OF THE INVENTION

The subject invention is concerned generally with a process for the preparation of a feedstock for carbon artifact manufacture from carbonaceous residues of petroleum origin including distilled or cracked residuums of crude oil and hydrodesulfurized residues of distilled or cracked crude oil. More particularly, the invention is concerned with the treatment of carbonaceous graphitizable petroleum pitches to obtain a feedstock eminently suitable for carbon fiber production.

DESCRIPTION OF THE PRIOR ART

Carbon artifacts have been made by pyrolyzing a wide variety of organic materials. One carbon artifact of commercial interest today is carbon fiber. Hence, particular reference is made herein to carbon fiber technology. Nonetheless, it should be appreciated that this invention has applicability to carbon artifact formation generally and, most particularly, to the production of shaped carbon articles in the form of filaments, yarns, ribbons, films, sheets and the like.

Referring now in particular to carbon fibers, suffice it to say that the use of carbon fibers in reinforcing plastic and metal matrices has gained considerable commercial acceptance where the exceptional properties of the reinforcing composite materials such as their high strength-to-weight ratios clearly offset the generally high costs associated with preparing them. It is generally accepted that large scale use of carbon fibers as a reinforcing material would gain even greater acceptance in the marketplace if the costs associated with the formation of the fibers could be substantially reduced. Thus, the formation of carbon fibers from relatively inexpensive carbonaceous pitches has received considerable attention in recent years.

Many carbonaceous pitches are known to be converted at the early stages of carbonization to a structurally ordered, optically anisotropic spherical liquid called mesophase. The presence of this ordered structure prior to carbonization is considered to be a significant determinant of the fundamental properties of any carbon artifact made from such a carbonaceous pitch. The ability to generate high optical anisotropicity during processing is generally accepted, particularly in carbon fiber production, as a prerequisite to the formation of high quality products. Thus, one of the first requirements of any feedstock material suitable for carbon fiber production is its ability to be converted to a highly optically anisotropic material.

As is well known, pitches typically include insoluble and infusible materials which are insoluble in organic solvents such as quinoline or pyridine. These insoluble materials, commonly referred to as quinoline insolubles, normally consist of coke, carbon black, catalyst fines and the like. In carbon fiber production, it is necessary, of course, to extrude the pitch through a spinnerette having very fine orifices. Consequently, the presence of any quinoline insoluble material is highly undesirable since it can plug or otherwise foul the spinnerette during fiber formation.

Additionally, since many carbonaceous pitches have relatively high softening points, incipient coking frequently occurs in such materials at temperatures where they exhibit sufficient viscosity for spinning. The presence of coke and other infusible materials and/or undesirably high softening point components generated prior to or at the spinning temperatures are detrimental to processability and product quality. Moreover, a carbonaceous pitch or feedstock for carbon fiber production must have a relatively low softening point or softening point range and a viscosity suitable for spinning the feedstock into fibers. Finally, the feedstock must not contain components which are volatile at spinning or carbonization temperatures since such components also are detrimental to product quality.

Significantly, it recently has been disclosed in U.S. Patent Application Ser. No. 903,172, filed May 5, 1978, now U.S. Pat. No. 4,208,267, that typical graphitizable carbonaceous pitches contain a separable fraction which possesses very important physical and chemical properties insofar as carbon fiber processing is concerned. Indeed, this separable fraction of typical graphitizable carbonaceous pitches exhibits a softening range and viscosity suitable for spinning and has the ability to be converted rapidly at temperatures in the range generally of about 230° C. to about 400° C. to an optically anisotropic deformable pitch containing greater than 75% of a liquid crystal type structure. Since this highly oriented optically anisotropic pitch material formed from a fraction of an isotropic carbonaceous pitch has substantial solubility in pyridine and quinoline, it has been named neomesophase to distinguish it from the pyridine and quinoline insoluble liquid crystal materials long since known and referred to in the prior art as mesophase. The amount of this separable fraction of pitch present in well known commercially available graphitizable pitches, such as Ashland 240 and Ashland 260, to mention a few, is relatively low; however, as is disclosed in copending application Ser. No. 903,171, filed May 5, 1978, now U.S. Pat. No. 4,184,942, the amount of that fraction of the pitch which is capable of being converted to neomesophase can be increased by heat soaking graphitizable isotropic carbonaceous pitches at temperatures in the range of about 350° C. to about 450° C. generally until spherules can be observed visually in samples of the heated pitch under polarized light at magnification factors of from 10X to 1000X. Heating of such pitches tends to result in the generation of additional solvent insoluble solids, both isotropic and anisotropic, having significantly higher softening points and viscosities which are generally not suitable for spinning.

In copending application U.S. Ser. No. 29,760, filed Apr. 13, 1979, there is disclosed a process for separating the quinoline insoluble substances and other undesirable high softening point components present in isotropic carbonaceous feedstocks, and particularly isotropic carbonaceous graphitizable pitches, by fluxing the feedstock with an organic solvent, thereby providing a fluid pitch having substantially all of the quinoline insoluble material of the pitch suspended in the fluid and thereafter separating the suspended solid by such standard separation techniques such as filtration, centrifugation and the like. The fluid pitch free of suspended solids is then treated with an antisolvent compound so as to precipitate at least a substantial portion of the pitch free of quinoline insoluble solids and capable of being thermally converted to neomesophase.

SUMMARY OF THE INVENTION

The present invention contemplates heat soaking of a fluxed isotropic carbonaceous pitch, especially the continuous heat soaking of the fluxed pitch, thereby facilitating the handling of the pitch, the separation of quinoline insolubles and other high softening components from the pitch, and the subsequent separation of that fraction of the pitch which is capable of being rapidly converted by heating to an optically anisotropic phase suitable in carbon artifact manufacture.

Broadly stated, the present invention comprises: fluxing an isotropic carbonaceous pitch thereby rendering the pitch fluid. Next, the fluxed pitch is introduced into a heating zone where the temperature is maintained in the range of from about 350° C. to about 450° C., thereby resulting in the heat soaking of the fluxed pitch. In a continuous process, at least some of the fluxed pitch is simultaneously removed or drawn off from the heating zone and transferred to a cooling zone. The temperature in the cooling zone generally ranges from above the freezing point of the fluxed pitch to below the temperature in the heating zone, and in a particularly preferred embodiment is maintained at the boiling point of the organic liquid used to flux the pitch. Any solids suspended in the fluxed pitch after heat soaking and cooling are removed by filtering or the like. Thereafter, the fluxed, heat soaked pitch is treated with an antisolvent compound so as to precipitate at least a portion of the pitch free of quinoline insoluble solids.

The fluxing compounds suitable in the practice of the present invention include toluene, light aromatic gas oil, heavy aromatic gas oil, tetralin and the like when used in the ratio, for example, of from about 0.5 parts by weight of fluxing compound per weight of pitch to about 3 parts by weight of fluxing compound per weight of pitch. Preferably the weight ratio of fluxing compound to pitch is in the range of about 0.5 to about 1:1.

Among the anti-solvents suitable in the practice of the present invention are those solvents in which isotropic carbonaceous pitches are relatively insoluble and such anti-solvent substances include aliphatic and aromatic hydrocarbons such as heptane and the like. For reasons which are described hereinafter in greater detail, it is particularly preferred that the anti-solvent employed in the practice of the present invention have a solubility parameter of between about 8.0 and 9.5 at 25° C.

These and other embodiments of the present invention will be more readily understood from the following detailed description, particularly when read in conjunction with the accompanying drawings.

DETAILED DESCRIPTION OF THE INVENTION

Figure 1:
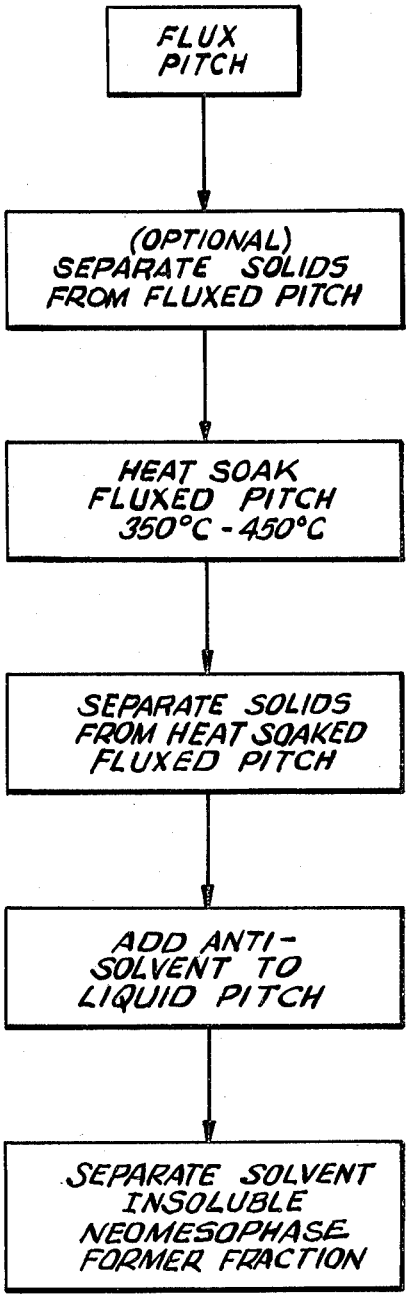
FIG. 1 is a flow chart illustrating the process of the present invention.

The term "pitch" as used herein means petroleum pitches, natural asphalt and pitches obtained as by-products in the naphtha cracking industry, pitches of high carbon content obtained from petroleum, asphalt and other substances having properties of pitches produced as by-products in various industrial production processes.

The term "petroleum pitch" refers to the residuum carbonaceous material obtained from the thermal and catalytic cracking of petroleum distillates including a hydrodesulfurized residuum of distilled and cracked crude oils.

Generally pitches having a high degree of aromaticity are suitable for carrying out the present invention. Indeed, aromatic carbonaceous pitches having high aromatic carbon contents of from about 75% to about 90% as determined by nuclear magnetic resonance spectroscopy are generally useful in the process of this invention. So, too, are high boiling, highly aromatic streams containing such pitches or that are capable of being converted into such pitches.

On a weight basis, the useful pitches will have from about 88% to about 93% carbon and from about 7% to about 5% hydrogen. While elements other than carbon and hydrogen, such as sulfur and nitrogen, to mention a few, are normally present in such pitches, it is important that these other elements do not exceed 4% by weight of the pitch, and this is particularly true when forming carbon fibers from these pitches. Also, these useful pitches typically will have a number average molecular weight range of the order of about 300 to 4,000.

Those petroleum pitches which are well known graphitizable pitches meeting the foregoing requirements are preferred starting materials for the practice of the present invention. Thus, it should be apparent that carbonaceous residues of petroleum origin, and particularly isotropic carbonaceous petroleum pitches which are known to form mesophase in substantial amounts, for example in the order of 75% to 95% by weight and higher, during heat treatment at elevated temperatures, for example in the range of 350° C. to 450° C., are especially preferred starting materials for the practice of the present invention.

As stated above, it has been recently discovered that pitches of the foregoing type have a solvent insoluble separable fraction which is referred to as a neomesophase former fraction, of NMF fraction, which is capable of being converted to an optically anisotropic pitch containing greater than 75% of a highly oriented liquid crystalline materials referred to as neomesophase. Importantly, the NMF fraction, and indeed the neomesophase itself, has sufficient viscosity at temperatures in the range, for example, of 230° C. to about 400° C., such that it is capable of being spun into pitch fiber. The amount of neomesophase former fraction of the pitch tends, however, to be relatively low. Thus, for example, in a commercially available graphitizable isotropic carbonaceous pitch such as Ashland 240, no more than about 10% of the pitch constitutes a separable toluene insoluble fraction capable of being thermally converted to neomesophase.

In accordance with the practice of the present invention, and as shown in the flow plan of FIG. 1, the isotropic carbonaceous pitch is fluxed, i.e., the fusion point of the pitch is lowered or the pitch is liquified, by mixing an appropriate organic fluxing liquid with the pitch.

As used herein, the term "organic fluxing liquid", then, refers to an organic solvent which is nonreactive toward the carbonaceous graphitizable pitch and which, when mixed with the pitch in sufficient amounts, will render the pitch sufficiently fluid, especially at temperatures generally in the range of from about 20° C. to about 100° C., so that it can be easily handled. If the pitch employed is a bottom fraction of a typical petroleum process, it will likely contain catalyst fines, ash and other quinoline insoluble materials. Consequently, the fluxing liquid will be one which in those instances causes substantially all of the quinoline insoluble fraction of the pitch to be suspended in the fluid pitch. Since the fluxed pitch is to be heated at elevated temperatures, the fluxing liquid preferably will have a boiling point greater than about 100° C., and most preferably in the range of from about 110° C. to about 450° C. Typical organic fluxing liquids suitable in the practice of the present invention include light aromatic gas oils, heavy aromatic gas oils, toluene, xylene and tetralin.

As should be readily appreciated, the amount of organic fluxing liquid employed will vary depending upon the temperature at which the mixing is conducted, and, indeed, depending upon the composition of the pitch itself. As a general guide, however, the amount of organic fluxing liquid employed will be in the range of about 0.5 parts by weight of organic liquid per part by weight of pitch to 3 parts by weight of organic liquid per part by weight of pitch. Preferably the weight ratio of flux to pitch will be in the range of from 0.5 to 1:1. The desirable ratio of fluxing liquid to pitch can be determined very quickly on a sample of the pitch by measuring the amount of fluxing liquid required to lower the viscosity of the pitch sufficiently at the desired temperature and pressure conditions so that the pitch will be able to flow through a screen, for example, generally with suction filtration, to remove any large size solids suspended therein. Optionally, the amount of fluxing liquid may be sufficient so that at the desired temperature and pressure conditions the pitch will be sufficiently fluid so as to pass through a half micron filter with suction filtration. As a further example, it has been found that 0.5 parts by weight of toluene per part by weight of Ashland 240 is sufficient to render the pitch fluid at ambient temperatures.

After fluxing the pitch, any of the quinoline insolubles suspended in the fluid pitch are optionally and preferably separated from the fluxed pitch by standard liquid-solid separation techniques such as sedimentation, centrifugation or filtration.

As will be readily appreciated, if filtration is the selected separation technique employed, a filter aid can be used if so desired to facilitate the separation of the fluid pitch from the insoluble material suspended in the pitch.

After separation of the solid material suspended in the fluid pitch, the fluid pitch is introduced, preferably continuously, into a heating zone where it is heat soaked at temperatures in the range of from about 350° C. to about 450° C. for a time sufficient to increase the amount of that fraction of the pitch which is capable of being thermally converted into an optically anisotropic phase which has a suitable viscosity for spinning into fibers at temperatures of about 230° C. to about 400° C. In general, the heat soaking will be for a time ranging from about 30 minutes to about 300 minutes.

After heat soaking the pitch, the fluxed pitch is then transferred to a cooling zone. Basically, the temperature in the cooling zone will range from above the freezing point of the fluxed and heat soaked pitch to below the temperature in the heating zone. Indeed, in a particularly preferred embodiment of the present invention, the temperature in the cooling zone is maintained at the boiling point of the organic liquid used to flux the pitch. Thus, for example, when toluene is used as the organic liquid for fluxing the pitch, the temperature in the cooling zone will be maintained at refluxing toluene temperatures.

As will be readily appreciated, in a continuous process fluxed pitch will be fed into the heating zone and a portion of the fluxed pitch in the heating zone will be drawn off and transferred to the cooling zone at a rate such that the average residence time of the fluxed pitch in the heating zone will be sufficient to increase that fraction of the pitch which is capable of being thermally converted to an optically anisotropic phase with a viscosity suitable for spinning into fibers at temperatures in the range of about 230° C. to about 400° C. The residence time typically for a fluxed pitch in the heating zone will be in the range of about 30 minutes to about 300 minutes.

Since the heating of the fluxed pitch tends to result in the generation of materials that have much higher softening points and viscosities than the fluxed pitch, these materials will tend to begin to separate in the cooling zone. Consequently, the fluxed pitch from the cooling zone containing solids suspended therein is separated from the solids by standard solid-liquid separation techniques. Preferably prior to separation of the solids, the temperature of the fluxed pitch is lowered to ambient temperature.

After separation of the solid material suspended in the fluxed and heat soaked pitch, the fluid pitch is then treated with an anti-solvent, also preferably at ambient temperature. Thus, for example, in the case where filtration is used to separate the solid suspended matter from the fluid pitch, the filtrate is mixed with an organic liquid which is capable of precipitating at least a substantial portion of the pitch.

As will be appreciated, any solvent system, i.e., a solvent or mixture of solvents, which will result in the precipitation and flocculation of the fluid pitch can be employed in the practice of the present invention. However, since it is particularly desirable in the practice of the present invention to use that fraction of the pitch which is convertible into neomesophase, a solvent system particularly suitable in separating the neomesophase former fraction of the pitch from the remainder of the isotropic pitch is particularly preferred for precipitating the pitch.

Typically such solvent systems include aromatic hydrocarbons such as benzene, toluene, xylene and the like, and mixtures of such aromatic hydrocarbons with aliphatic hydrocarbons such as toluene-heptane mixtures. The solvents or mixtures of solvents typically will have a solubility parameter of between about 8.0 and 9.5 and preferably between about 8.7 and 9.2 at 25° C. The solubility parameter, $\gamma$, of a solvent or a mixture of solvents is given by the expression $$\gamma = \left(\frac{H_v - RT}{V}\right)^{\frac{1}{2}}$$

where $H_v$ is the heat of vaporization of the material, R is the molar gas constant, T is the temperature in degrees K and V is the molar volume. In this regard, see, for example, J. Hildebrand and R. Scott, "Solubility of Non-Electrolytes", 3rd edition, Reinhold Publishing Company, New York (1949) and "Regular Solutions", Prentice Hall, New Jersey (1962). The solubility parameters at 25° for some typical hydrocarbons in commercial $C_6$ to $C_8$ solvents are as follows: benzene, 9.2; toluene, 8.9; xylene, 8.8; n-hexane, 7.3; n-heptane, 7.4; methyl cyclohexane, 7.8; and cyclohexane, 8.2. Among the foregoing solvents, toluene is preferred. Also, as is well known, solvent mixtures can be prepared to provide a solvent system with the desired solubility parameter. Among mixed solvent systems, a mixture of toluene and heptane is preferred, having greater than about 60 volume % toluene, such as 60% toluene/40% heptane, and 85% toluene/15% heptane.

The amount of anti-solvent employed will be sufficient to provide a solvent insoluble fraction which is capable of being thermally converted to greater than 75% of an optically anisotropic material in less than ten minutes. Typically, the ratio of organic solvent to pitch will be in the range of about 5 ml to about 150 ml of solvent per gram of pitch.

After precipitation of the pitch and particularly in the instances where the proper solvent system was used, separation of the neomesophase former fraction of the pitch can be readily effected by normal solid separation techniques such as sedimentation, centrifugation, and filtration. If an anti-solvent is used which does not have the requisite solubility parameter to effect separation of the neomesophase former fraction of the pitch, it will, of course, be necessary to separate the precipitated pitch and extract the precipitate with an appropriate solvent as described above to provide the neomesophase former fraction.

In any event, the neomesophase former fraction of the pitch prepared in accordance with the process of the present invention is eminently suitable for carbon fiber production. Indeed, the pitch treated in accordance with the present invention is substantially free from quinoline insoluble materials as well as substantially free from other pitch components which detrimentally affect the spinnability of the pitch because of their relatively high softening points. Importantly, the neomesophase former fraction of various pitches obtained in accordance with the practice of the present invention have softening points in the range of about 250° to about 400° C.

Figure 2:
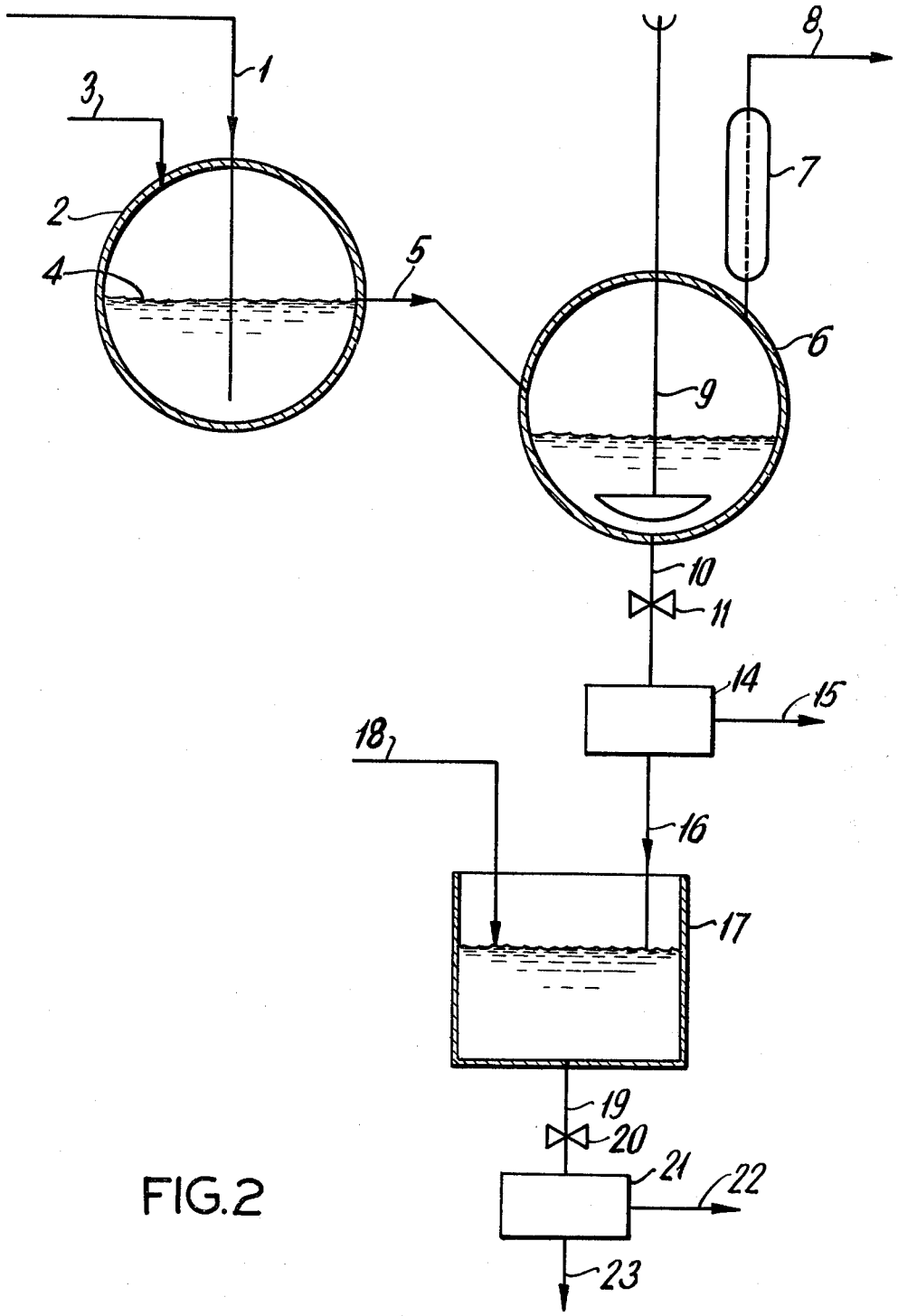
FIG. 2 is a schematic flow diagram of a process for producing a feedstock eminently suitable for carbon fiber formation in accordance with the present invention.

Reference is now made specifically to the particularly preferred embodiment of the present invention shown in FIG. 2 wherein a residue of petroleum origin such as distilled or cracked residuum of petroleum pitch or other commercially available petroleum pitch is fluxed with an organic fluxing material having a boiling point generally below about 150° C. In the embodiment detailed herein, the organic fluxing liquid is toluene. The fluxed pitch is continuously introduced via line 1 into heat soaking vessel 2. The heat soaking vessel is maintained at temperatures in the range of about 350° C. to about 450° C. Optionally and preferably the heating is started and done in an inert atmosphere such as nitrogen which can be introduced when desired via line 3. A mixer optionally can be provided in heat soaker 2; however, since the organic fluxing liquid has a boiling point below that of the temperature range being maintained in the heat soaker, mixing is not necessary if the fluxed pitch is introduced below the liquid level in the heat soaker. Thus, as is shown in FIG. 2, line 1 extends below the liquid level 4 in heat soaker vessel 2. Heat soaked and fluxed pitch is drawn off from the heat soaker 1 via line 5 and transferred to the cooling zone 6. Thus, fluxed pitch is being introduced continuously into the heat soaker and being removed continuously therefrom at a rate sufficient to maintain the residence time in the heat soaker in the range of about 30 to 300 minutes. The cooling zone vessel 6 is equipped with a reflux condenser or cooling tower 7, thereby providing for the automatic cooling of the fluxed liquid in the cooling zone to a temperature below the temperature in the heat soaker. Thus, in the instance where toluene is employed as the organic fluxing liquid, the material being drawn off from the heat soaker will consist in part of toluene vapors which will be cooled in the condenser and returned to the pitch in the vessel 6 thereby cooling the material being removed from the heat soaker. Decomposition gases, of course, can be removed from the system via line 8. Also, as is shown, cooling vessel 6 may contain an optional stirrer 9. Cooled product can be removed via line 10 and valve 11 for subsequent filtration in zone 14. The solids are removed from zone 14 by line 15. The filtrate is passed via line 16 to precipitation zone 17 where it is treated with an anti-solvent introduced, for example, by line 18.

After precipitation of the desired fraction by mixing with anti-solvent, the mixture is removed via line 19 and valve 20 and filtered in zone 21 to separate the solid neomesophase former fraction of the pitch. The solid is removed, for example, via line 22 and the anti-solvent via line 23. The anti-solvent, of course, can be recycled either as is, or, if necessary, after appropriate purification.

A more complete understanding of the process of the invention can be obtained by reference to the following example which is illustrative only and not meant to limit the scope thereof which is fully disclosed in the hereinafter appended claims.

EXAMPLE

A commercially available petroleum pitch (Ashland 240) was fluxed with toluene by mixing the pitch with toluene in the weight ratio of 0.5 to 1. The fluxed pitch was fed continuously at a rate of 0.33 vol/reactor vol/Hr to a round bottom vessel which was maintained at a temperature in the range of 415° C. to 435° C. The fluxed pitch was introduced into the round bottom vessel below the draw-off line for liquid in that vessel which resulted in sufficient agitation to keep the fluxed pitch that was being heated well mixed. The heat soaked pitch was withdrawn by a horizontal line at about mid-point in the vessel and delivered to a second round bottom vessel which was fitted with a reflux condenser. Consequently, the rate of withdrawal of fluxed pitch from the heating zone was equal to the rate of introduction therein and the so-withdrawn pitch was maintained at fluxing toluene temperature. Product was withdrawn from the second vessel and centrifuged at room temperature where the centrifuged liquid was treated with excess toluene in the ratio of 16 parts of toluene per part of centrifugate to provide 22.9 wt. % of a toluene insoluble material which had a softening range of from about 350° C. to about 375° C.

The softening range of the sample was determined in a nitrogen blanketed capped NMR tube. Additionally, after heating to a temperature within the softening range, the heated pitch was examined under polarized light by mounting a sample on a slide with Permount, a histological mounting medium sold by Fischer Scientific Company, Fairlawn, New Jersey. A slip cover was placed over the slide by rotating the cover under hand pressure and the mounted sample was crushed to a powder and evenly dispersed on the slide. Thereafter the crushed sample was viewed under polarized light at a magnification factor of 200X and the percent optical anisotropy was estimated to be greater than 75%. Thus, the product had the requisite properties for a carbon fiber feedstock.

What is claimed is:

1. A process for treating a carbonaceous pitch comprising:

(a) mixing said pitch with an organic fluxing liquid to form a fluid pitch;

(b) heating said fluid pitch at temperatures in the range of from about 350° C. to about 450° C.;

(c) separating solids suspended in said heated, fluid pitch;

(d) treating said fluid pitch with an organic solvent system having a solubility parameter at 25° C. of between about 8.0 and about 9.5, said treating being at a temperature and with an amount of organic solvent system sufficient to provide a solvent insoluble fraction thermally convertible into a deformable pitch containing greater than 75% of an optically anisotropic phase; and (e) recovering said solvent insoluble fraction.

2. The process of claim 1 wherein said fluxing liquid is selected from the group consisting of light aromatic gas oils, heavy aromatic gas oils, toluene, xylene and tetralin.

3. The process of claim 2 wherein said pitch is heated for a time ranging from about 30 minutes to about 300 minutes.

4. The process of claim 3 wherein said organic fluxing liquid is employed in the range of about 0.5 to 3 parts by weight of liquid per part of pitch.

5. The process of claim 4 wherein the weight ratio of fluxing liquid to pitch is in the range of 0.5 to 1:1.

6. The process of claim 5 wherein said pitch is cooled to a temperature below said heating temperature before separating solids suspended in said pitch.

7. A process for preparing a feedstock suitable for carbon artifact manufacture comprising:

(a) providing an isotropic carbonaceous pitch;

(b) mixing said pitch with an organic fluxing liquid to form a fluid pitch;

(c) continuously feeding said fluid pitch to a heat zone maintained at a temperature in the range of about 350° C. to about 450° C., while (d) simultaneously removing fluid pitch from said heating zone to a cooling zone maintained at a temperature below the temperature in said heating zone, the rate of feeding and removing fluid pitch from the heating zone sufficient to provide a residence time therein of about 30 minutes to about 300 minutes;

(e) removing the heated fluid pitch from the cooling zone and separating solids therefrom;

(f) treating said fluid pitch with an organic solvent system in an amount sufficient to precipitate that fraction of said pitch which is capable of being thermally converted to an optically anisotropic phase; and, (g) recovering said precipitated fraction.

8. The process of claim 7 wherein said fluxing liquid is selected from the group consisting of light aromatic gas oils, heavy aromatic gas oils, toluene, xylene and tetralin in an amount ranging from about 0.5 to 3 parts by weight of liquid per part of pitch.

9. The process of claim 8 wherein the weight ratio of fluxing liquid to pitch is in the range of 0.5 to 1:1.

10. The process of claim 9 wherein said organic solvent system for treating said pitch is one having a solubility parameter at 25° C. of between about 8.0 and 9.5 whereby said fraction of said pitch precipitated is capable of being thermally converted into deformable pitch containing greater than 75% of an optically anisotropic phase.

* * * * *